US007235002B1

(12) United States Patent
Pride

(10) Patent No.: US 7,235,002 B1
(45) Date of Patent: Jun. 26, 2007

(54) METHOD AND SYSTEM FOR MAKING GLASS SHEETS INCLUDING GRINDING LATERAL EDGE(S) THEREOF

(75) Inventor: Thomas E. Pride, DeWitt, IA (US)

(73) Assignee: Guardian Industries Corp., Auburn Hills, MI (US)

( * ) Notice: Subject to any disclaimer, the term of this patent is extended or adjusted under 35 U.S.C. 154(b) by 0 days.

(21) Appl. No.: 11/337,110

(22) Filed: Jan. 23, 2006

(51) Int. Cl.
*B24B 1/00* (2006.01)
*B24B 7/00* (2006.01)

(52) U.S. Cl. ..... 451/43; 451/44; 451/121; 451/139; 451/184

(58) Field of Classification Search ..... 451/43, 451/44, 121, 131, 139, 184
See application file for complete search history.

(56) References Cited

U.S. PATENT DOCUMENTS 3,283,447 A * 11/1966 Cretsinger ..... 451/303
3,510,987 A * 5/1970 Ernst ..... 451/300
4,042,230 A * 8/1977 Akimoto ..... 267/136
4,054,010 A 10/1977 Shipman
4,081,927 A 4/1978 Kelly
4,258,506 A * 3/1981 Robinson ..... 451/300
4,525,958 A 7/1985 Reissig
4,587,769 A 5/1986 Cathers
4,621,464 A 11/1986 Kelly
4,640,056 A * 2/1987 Stump ..... 451/300
4,679,354 A * 7/1987 Holst et al. ..... 451/184
4,719,721 A * 1/1988 Stump ..... 451/300
4,897,968 A * 2/1990 Hutt ..... 451/505
5,109,632 A * 5/1992 Hostler et al. ..... 451/59
5,146,715 A * 9/1992 Bando ..... 451/11
5,433,652 A * 7/1995 Park ..... 451/9
5,830,046 A * 11/1998 Dugger et al. ..... 451/297
5,928,060 A 7/1999 Miller
6,102,781 A * 8/2000 Greathouse et al. ..... 451/59
6,325,704 B1 12/2001 Brown et al.
6,602,120 B2 * 8/2003 Bavelloni ..... 451/236
6,609,956 B2 8/2003 Margaria
6,623,344 B2 9/2003 Inaba
6,685,541 B2 2/2004 Brown et al.

* cited by examiner

*Primary Examiner*—M. Rachuba
(74) *Attorney, Agent, or Firm*—Nixon & Vanderhye P.C.

(57) ABSTRACT

A method and system for making glass sheets is provided. At least one grinding wheel is provided for grinding a lateral edge of a glass sheet. An airbag and corresponding air pressure regulator are provided for biasing the grinding wheel against the lateral edge of the glass sheet being ground. In certain example embodiments, the airbag is advantageous in that it permits the grinding wheel to be biased against the lateral edge of the glass sheet with a substantially constant pressure, where this pressure does not substantially fluctuate due to small changes in the location of the edge of the passing glass.

18 Claims, 2 Drawing Sheets

METHOD AND SYSTEM FOR MAKING GLASS SHEETS INCLUDING GRINDING LATERAL EDGE(S) THEREOF

This invention relates to a method of making glass sheets, and a corresponding system for making glass sheets. In particular, at least one grinding wheel (or medium) is provided for grinding a lateral edge of a glass sheet. An airbag is provided for biasing the grinding wheel against the lateral edge of the glass sheet being ground. In certain example embodiments, the airbag is advantageous in that it permits the grinding wheel to be biased against the lateral edge of the glass sheet with a substantially constant pressure, where this pressure does not substantially fluctuate due to small changes in the location of the edge of the passing glass.

BACKGROUND OF THE INVENTION

The edges of glass sheets are conventionally finished by passing glass sheets by one or more grinding wheels that grind the lateral edge(s) of the glass sheet. This grinding is sometimes called "seaming" in the glass manufacturing art. This grinding is also sometimes called "polishing" in the glass manufacturing art. Thus, the term "grinding" as used herein covers seaming and polishing of glass sheet edges as will be appreciated by those of skill in the art. For example and without limitation, example edge grinding is disclosed in U.S. Pat. No. 6,685,541, the disclosure of which is hereby incorporated herein by reference.

Prior art FIG. 3 is a drawing taken from U.S. Pat. No. 6,685,541, and is provided for purposes of understanding with respect to edge grinding of glass sheets. In FIG. 3, a plurality of grinding wheels are provided on each side of the glass sheets. FIG. 3 illustrates a glass sheet designated generally by reference numeral 10 being conveyed on a conveyor system in the direction of arrow 15 while both edges of the glass sheet 10 are being ground (which includes polishing) by grinding wheels 20A, 20B, 30A, 30B. The grinding wheels 20A, 20B, 30A and 30B have respective grinding surfaces 22, 21, 32 and 31. Grinding wheels 20A and 20B may be more coarse than grinding wheels 30A and 30B in certain example instances. The major surfaces 19, 23, 29 and 33 of the grinding wheels are parallel to the major surface 16 of the glass sheet 10. In FIG. 3, grinding wheels 20A and 20B may rotate in opposite directions (e.g., wheel 20A may rotate in a counterclockwise direction and wheel 20B in a clockwise direction). Similarly, grinding wheels 30A and 30B which may perform a polishing effect may also rotate in opposite directions. Grinding wheels 20A and 30A grind the lateral edge 12 of the glass sheet 10, whereas grinding wheels 20B and 30B grind the opposite lateral edge 14 of the glass sheet 10, as the conveyor system including belts 17, 17' and rotating wheels 18 conveys the glass sheet 10 by the grinding wheels. The belts 17 below the glass sheet(s) 10 may said to be support belts or tractor belts, whereas the belts 17' above or over the glass sheet(s) 10 may be referred to as hold-down belts. The hold-down belts 17' in FIG. 3, which are to be provided over the glass sheet(s) 10, are only partially illustrated for purposes of simplicity.

Conventionally, the grinding wheels are biased against the respective glass edges by air cylinders or springs. Unfortunately, the use of an air cylinder or spring to bias a grinding wheel against a glass edge is highly problematic for at least the following reasons. As glass sheets are conveyed by a grinding wheel, the lateral edges of the glass sheets are not always in the exact same location. In particular, the position of a given edge of a glass sheet is often laterally offset from one glass sheet to the next, and sometimes even within a single glass sheet if that sheet is slightly misaligned or has a crooked lateral edge. When the edge of a moving glass sheet moves toward the center of the grinding wheel (compared to a previous edge or edge portion of another glass sheet or even the same glass sheet), this creates an added force against the grinding wheel. When an air cylinder or spring is being used to bias the grinding wheel against the glass edge, this causes a contraction in the stationary air cylinder or spring which in turn causes the pressure in the air cylinder or spring to increase significantly thereby significantly increasing the force with which the grinding wheel is biased against the glass edge.

For example, when an air cylinder or spring is used to bias the grinding wheel against a glass edge(s), one inch of lateral movement of a glass edge toward the grinding wheel may result in a bias force (force by which the grinding wheel is biased against the glass edge) increase of from about 5 psi to about 10 psi. Thus, it will be appreciated that small changes in the position of a glass edge result in significantly different bias forces being applied to the grinding wheel for biasing the wheel against the glass edge(s). This is highly problematic in that such unpredictable fluctuations in biasing force (a) cause significantly increased wear on the grinding wheel, and (b) result in an uneven or non-uniform grinding of the edge(s) since the biasing force is continuously changing to significant degrees.

In view of the above, it will be appreciated that there exists a need in the art for a method and system for grinding edges of glass sheets which is more tolerant of changes in position of lateral edges of glass sheets passing by a grinding wheel(s). For instance, there exists a need in the art for method and system for biasing a grinding wheel(s) against a glass edge(s) in a manner that does not result in substantial pressure or biasing force fluctuations upon the occurrence of small changes in location of glass edge(s).

BRIEF SUMMARY OF EXAMPLE EMBODIMENTS OF THE INVENTION

Grinding of lateral edge(s) of glass sheets is improved in certain example embodiments of this invention. In certain example embodiments, the grinding bevels off any potential fracture damage from the edge(s) of the glass sheets. In certain example embodiments, the glass may be heat treated (e.g., thermally tempered) after the edge grinding has been completed.

For edge grinding, at least one grinding wheel is provided for grinding at least one lateral edge of a glass sheet(s). The grinding wheel is biased against the edge of the glass sheet being ground in order to effect the grinding. In certain example embodiments of this invention, at least one airbag and corresponding air pressure regulator(s) is/are provided for biasing the grinding wheel against the lateral edge of the glass sheet being ground. Surprisingly, it has been found that the use of the airbag is advantageous in that it permits the grinding wheel to be biased against the lateral edge of the glass sheet with a substantially constant pressure, and unexpectedly this pressure does not substantially fluctuate due to small changes in the lateral location of the edge of the passing glass. Thus, it will be appreciated that small changes in the position of a glass edge do not result in significantly different bias forces being applied to the grinding wheel for biasing the wheel against the glass edge(s) when the airbag (s) is used.

Accordingly, the use of the airbag is used to solve the aforesaid problems. In particular, the use of the airbag and optionally the air pressure regulator reduces unnecessary wear on the grinding wheel, and provides for more uniform grinding of the glass edge(s) because the biasing force is not subjected to continuous significant changes. In certain example instances, it may allow a swing arm to have greater compliance swing to facilitate better grinding of skewed or mis-positioned lites/sheets.

In certain example embodiment of this invention, there is provided a method of making a glass sheet with at least one finished lateral edge, the method comprising: conveying the glass sheet past at least one grinding wheel; biasing the grinding wheel against a lateral edge of the glass sheet so that the grinding wheel grinds at least part of the lateral edge of the glass sheet; and wherein said biasing includes using an airbag and air pressure regulator in communication with the airbag to bias the grinding wheel against the lateral edge of the glass sheet.

In other example embodiments of this invention, there is provided a method of grinding at least one edge of a glass sheet, the method comprising: conveying the glass sheet by at least one grinding wheel; and biasing the grinding wheel against a lateral edge of the glass sheet so that the grinding wheel grinds at least part of the lateral edge of the glass sheet, the biasing comprising using an airbag to bias the grinding wheel against the lateral edge of the glass sheet.

In still further example embodiments of this invention, there is provided a system for grinding at least one edge of a glass sheet, the system comprising: a conveyor system for conveying a glass sheet past at least one grinding wheel; the grinding wheel for contacting a lateral edge of the glass sheet so as to grind at least part of the lateral edge of the glass sheet; and an airbag, and an air pressure regulator in communication with the airbag, for biasing the grinding wheel against the lateral edge of the glass sheet.

BRIEF DESCRIPTION OF THE DRAWINGS

FIG. 2 is a side cross sectional view illustrating a glass sheet to be ground in the system of FIG. 1, where the glass sheet is located between a supporting conveyor belt and a hold-down conveyor belt according to an example embodiment of this invention.

DETAILED DESCRIPTION OF EXAMPLE EMBODIMENTS OF THE INVENTION

Figure 1:
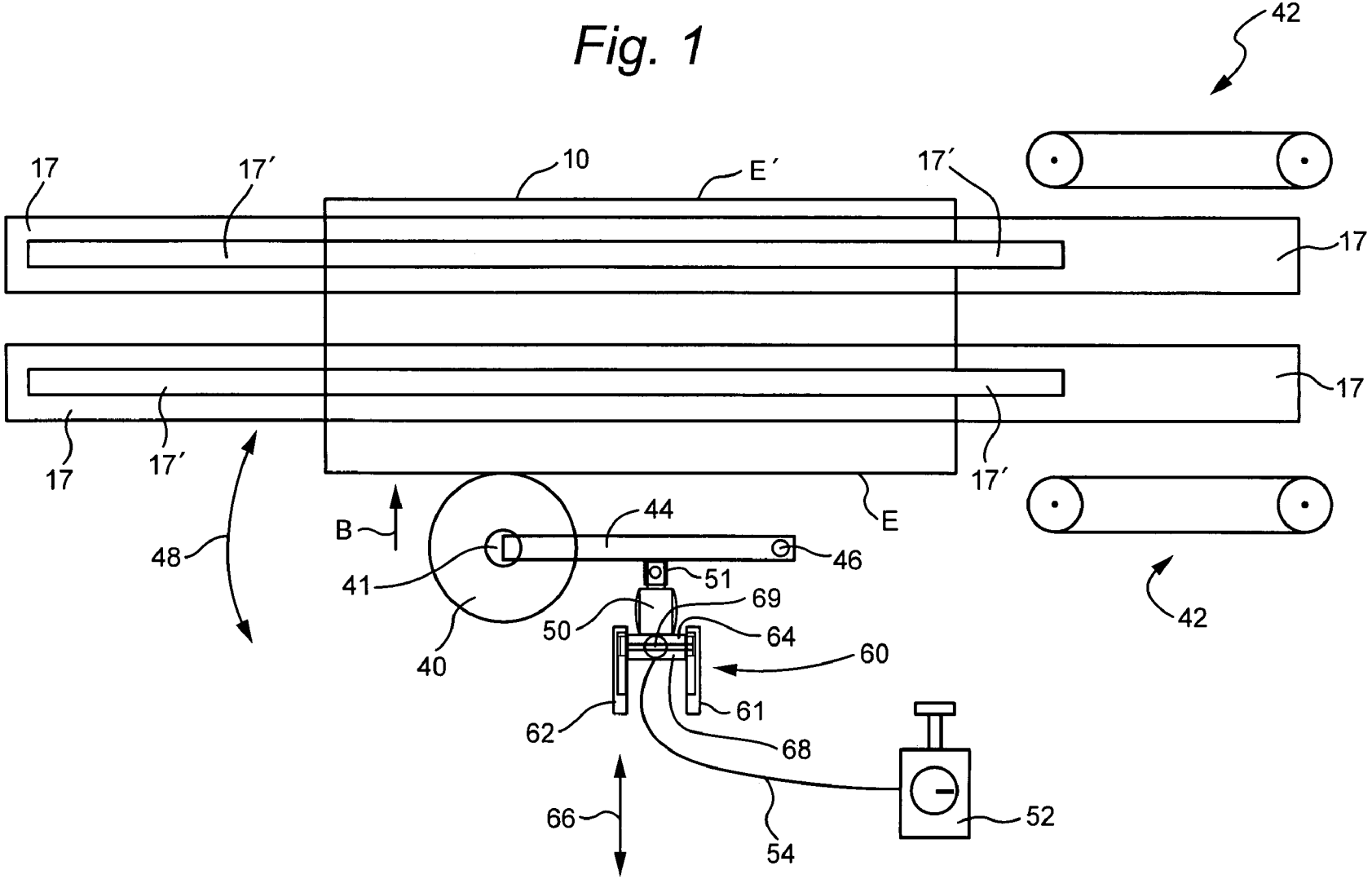
FIG. 1 is a top plan view of a system for grinding edges of glass sheets according to an example embodiment of this invention.
Figure 3:
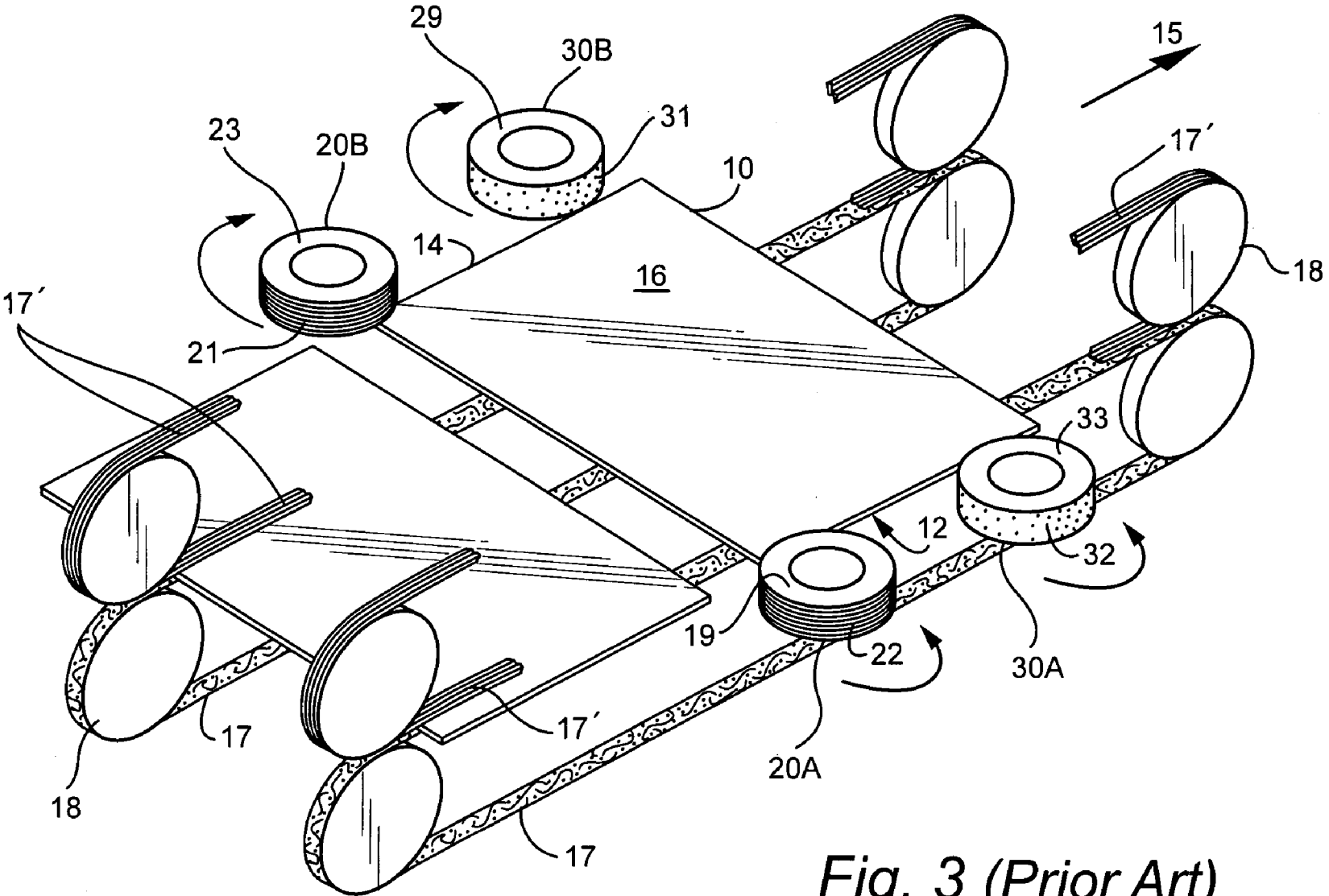
Fig. 3 (Prior Art)
FIG. 3 is a perspective view of a conventional system for grinding edges of glass sheets.

Referring now more particularly to the accompanying drawings in which like reference numerals refer to like parts throughout the several views.

In certain example embodiments of this invention, a method of making glass sheets is provided, as well as a corresponding system/apparatus for making glass sheets. The making of the glass sheets includes the grinding of at least one lateral edge (E or E') of the glass sheets 10. In certain example embodiments, the edge grinding may take place after the glass has been formed (e.g., via the float process), scored, and cut into smaller fabricating glass sheets 10 by fracturing or breaking the larger glass along the score lines. The grinding of edges (E or E') of these smaller glass sheets 10 may be performed to remove any roughness or fracture damage from the edge areas of the sheets which may have been caused during scoring and/or fracturing/breaking process. The glass 10 may be coated (e.g., with a low-E coating or the like) or uncoated at the time of grinding in different example embodiments of this invention. In certain example embodiments, the grinding bevels off any fracture damage from the edge(s) of the glass sheets. In certain example embodiments, the glass may be heat treated (e.g., thermally tempered) after the edge grinding has been completed.

FIG. 1 is a top view of a grinding apparatus or system according to an example embodiment of this invention. Glass sheets 10 are fed through the apparatus or system on support belts 17. In particular, conveyor belts 17 are located under the glass sheets 10 and convey the sheets 10 through the apparatus past the grinding wheel 40. Additionally, hold-down conveyor belts 17' may be provided over the glass sheets 10 as the sheets proceed through the apparatus in order to prevent the sheets 10 from jumping upwardly or skewing during the grinding process. FIG. 2 is a cross sectional view which makes clear that the glass sheets 10 are located above supporting conveyor belts 17 and below hold-down conveyor belts 17'. Alignment guides 42, each including a belt around at least two wheels, may be provided to help the glass sheets 10 become properly aligned as the sheets enter the grinding system or apparatus.

In the FIG. 1 embodiment, at least one grinding wheel 40 is provided for grinding at least one lateral edge (E) of the illustrated glass sheet 10. However, additional grinding wheels 40 may be provided for also grinding edge E or for grinding the opposite lateral edge E'. The biasing system of this invention is applicable and may be used in conjunction with any of such grinding wheels 40, on one or both sides of the glass sheet(s). Grinding wheel 40 may be made of any suitable material such as diamond embedded in a metal matrix or the like (or any of the grinding wheel materials in any of U.S. Pat. Nos. 6,685,541 and/or 6,325,704, the disclosures of which are hereby incorporated herein by reference. For example, grinding wheel(s) herein may employ an abrasive media dispersed within a suitable carrier material such as a polymeric material or a metal matrix. Example abrasive media include alumina, SiC, pumice, and/or garnet in certain example instances. In certain example embodiments, the particle size of the abrasive media is no greater than about 220 grit, more preferably no greater than about 180 grit. In other example instances, the grinding wheel(s) may be a metal bonded grinding wheel with one or more grooves embedded with diamond particles. The diamond particles in certain grinding wheels may have a grit size of from about 50 to 800, more preferably from about 100 to 800, and most preferably from about 100 to 300.

Grinding wheel 40 is power driven to rotate about its center axis 41 in order to grind an edge of a passing glass sheet 10. Grinding wheel 40 is mounted on an end portion of pivoting swing arm 44 which pivots about axis 46. Thus, the pivoting swing arm 44 pivots in a manner about axis 46 so as to cause the grinding wheel 40 to move toward and away from the glass sheets 10 in directions 48 (see arrows 48 in FIG. 1). This movement of the swing arm 44 allows the grinding wheel 40 to be selectively engaged or disengaged with passing glass sheet(s) 10, and also allows the grinding wheel to move slightly back and forth in directions 48 during grinding operations to account for glass sheet edges (E and/or E') which may change position. As explained above, passing glass sheet 10 edges (e.g., see edge E in FIG. 1) may change lateral position in the plane of the sheet, either from one glass sheet 10 to the next, or even within a single glass sheet, for reasons such as glass sheets being of different sizes, glass sheets being misaligned on the conveyor belts, non-straight edges, and so forth.

The grinding wheel 40 is biased against the edge (E) of the glass sheet 10 shown in FIG. 1 being ground in order to effect the edge grinding. At least one airbag 50 and corresponding air pressure regulator(s) 52 are provided for biasing the grinding wheel 40 against the lateral edge (E) of the glass sheet 10 being ground. The airbag 50 biases the grinding wheel 40 in direction B shown in FIG. 1 against the edge (E), via biasing support 51 which may be made of metal or the like and is connected (e.g., pivotally connected) to the swing arm 44. The airbag is maintained in a partial compression state to create a floating effect that is balanced with only minimum work pressure needed to perform adequate grinding on the glass edge. Internal flex of the airbag allows extra give or relief to the instantaneous pressure generated when the grinding wheel is pushed back toward the airbag as the part enters compliance. Surprisingly, due to the self expansion nature of the airbag, it has been found that the use of the airbag 50 is advantageous in that it permits the grinding wheel to be biased against the lateral edge of the glass sheet with a substantially constant pressure, and unexpectedly this pressure does not substantially fluctuate due to small changes in the lateral location of the edge E of the passing glass 10. Thus, it will be appreciated that small changes in the position of a glass edge do not result in significantly different bias forces being applied to the grinding wheel 40 for biasing the wheel against the glass edge(s) when the airbag(s) is used. Accordingly, the use of the airbag 50, and air pressure regulator 52 for the airbag, are used to solve the problems discussed above so that the airbag and pressure regulator result in reduced unnecessary wear on the grinding wheel 40 and more uniform grinding of the glass edge(s) (E and/or E') because the biasing force is not subjected to continuous significant changes. Thus, the air bag permits substantially consistent pressure to be maintained by the grinding wheel 40 on the edge E for grinding purposes, while simultaneously allowing compliance with the edge, whereby an approximately constant bias force can be maintained even though the lateral position of edge E may change during the grinding operations.

Airbag 50 may be any sort of airbag having a flexible outer housing or diaphragm that contains air therein at a given pressure. A fluid air connection may be provided between the interior of airbag 50 and air pressure regulator 52 via air line or hose 54. This permits the high response regulator 52 to set the air pressure inside the airbag 50, and also to selectively adjust the pressure inside the airbag 50. Moreover, because regulator 52 is a high response regulator, it can also provide fast responses to relieve and/or add pressure to the airbag so as to keep the pressure inside the airbag substantially constant (e.g., constant plus/minus about 10%, more preferably plus/minus about 5%). For instance, if the glass edge E moves an inch or two toward the grinding wheel 40 this causes the airbag 50 to compress. If such compression of the airbag 50 causes the pressure therein to increase too much (e.g., more than 2, 5 or 10% for instance), then the regulator 52 can relieve pressure in the airbag 50 via hose 54 thereby allowing substantially same biasing force to be maintained on the glass edge E by the grinding wheel 40 even when the lateral position of the glass edge E changes.

In certain example embodiments of this invention, the pressure inside airbag 50 is kept within a desired range, such as from about 2 to 10 psi, more preferably from about 3–6 psi, and most preferably from about 3–5 or 4–5 psi. This has been found to be the optimum biasing force for biasing the grinding wheel 40 against the glass edge E. Too much pressure results in too much wear on the grinding wheel and possibly too much grinding, whereas too little force results in insufficient grinding. Moreover, significant changes in biasing force results in both non-uniform grinding, non-uniform edges, and excess wear on the grinding wheel. Regulator 52 functions to keep approximately this much pressure in the airbag 50 regardless of how much the airbag 50 is contracted or expanded by movement of edge E of the glass sheet 10.

With the conventional biasing structure where an air cylinder or spring is used to bias the grinding wheel against a glass edge(s), one inch of lateral movement of a glass edge (E) toward the grinding wheel typically result in a significant bias force (force by which the grinding wheel is biased against the glass edge) increase of from about 5 psi to about 10 psi due to the compression of the cylinder or spring. This was highly problematic. However, with the airbag 50 and regulator 52, this same one inch of lateral movement of the glass edge (E)) toward the grinding wheel results in much less of a biasing force change. In certain example embodiments of this invention, one inch of lateral movement of the glass edge (E) toward the grinding wheel 40 from the edge's normal operating position causes the pressure inside the airbag 50 to change by no more than about 2 psi, more preferably no more than about 1 psi, and most preferably no more than about 0.5 psi, and sometimes no more than about one quarter psi. In other example embodiments of this invention, one inch of lateral movement of the glass edge (E) toward the grinding wheel 40 from the edge's normal operating position causes the biasing force exerted by the airbag 50 to change by no more than about 15%, more preferably no more than about 10%, and most preferably by no more than about 5%. Thus, it will be appreciated that, unlike the conventional art, according to certain example embodiments of this invention small changes in the position of a glass edge (E) do not result in significantly different bias forces being applied to the grinding wheel for biasing the wheel against the glass edge(s).

The airbag 50 is mounted on, or directly or indirectly attached to, an adjustable support 60. Support 60 includes two approximately parallel members 61 and 62 which permit the airbag mount 64 to slide back and forth in directions 66 between the members 61, 62. Keys attached to either side of the airbag slide in elongated channels defined in inner sidewalls of members 61, 62 thereby allowing the airbag 50 to slide back and forth in directions 66 between members 61, 62 (e.g., for disengagement, or for adjustment purposes). The airbag mount 64 also includes a cross member 68 extending between members 61, 62, and the airbag is pivotally mounted to cross member 68 so as to pivot about pivot axis 69. Because the airbag 50 can pivot about axis 69, adjustment sliding directions 66 are kept perpendicular to the lengthwise direction of grinding wheel swing arm 44. In other words, the combination of pivot axis 69 at the rear end portion of the airbag 50 and sliding adjustment members 61, 62 allows the bias direction B of force provide by the airbag to be maintained perpendicular to the lengthwise direction of the swing arm 44 even when the swing arm 44 slightly pivots back and forth, and even when the position of the cross member 68 is moved toward or away from the swing arm in directions 66. Keeping the bias direction B perpendicular to the side of the swing arm 44 is advantageous in that it maintains efficiency of bias force/load and helps to keep a constant or substantially constant pressure on the grinding wheel 40 against glass edge E. Moreover, it is noted that sliding of cross member 68 and thus the airbag 50 in directions 66 may be used to: (a) adjust the position of the grinding wheel 40 relative to the glass edge E, (b) adjust biasing force, and/or (c) engage or disengage the grinding wheel from contact with the glass edge E.

The airbag 50 and regulator 52 biasing system shown in FIGS. 1–2 may be used with any type of grinding wheel 40 in different example embodiments of this invention. For example and without limitation, this biasing system may be used in conjunction with one or more of the grinding wheels disclosed in commonly owned U.S. Ser. No. 11/032,028, the disclosure of which is hereby incorporated herein by reference. As described in the '028 application, a method of using this system may include bringing one edge of a glass sheet into grinding contact with a tapered grinding surface of a first grinding wheel so that said one edge is beveled; and thereafter bringing another edge of the glass sheet into contact with a tapered grinding surface of a second grinding wheel, positioned downstream of said first grinding wheel, so that said another edge of the glass sheet is beveled. This invention is of course also applicable to other types of grinding wheels (e.g., V-groove grinding wheels), other types of grinding wheel systems, and so forth. Moreover, while this invention is typically used for grinding wheels that grind edges of glass sheets, this invention is not so limited as grinding wheel systems or methods of this invention may also be used to grind other types of material.

In certain example embodiments of this invention, low friction pivot points may be provided at axis 46 for allowing the swing arm 44 to pivot thereabout, and at axes 51, 69 for allowing the airbag and its bias direction B to pivot easily. Low friction movement of the entire assembly is advantageous in that it reduces or eliminates the need for excess pressure or force to overcome friction loss.

Conventional high pressure grinding systems (e.g., with cylinders or springs) bury or plow the grinding wheel into the glass edge causing increased wear while decreasing the ground surface quality. They also suffer from extreme peaks and valleys of pressure application as explained above. These high and low peaks in pressure are amplified when you increase the compliance movement to allow for product alignment as it is placed and presented to the grinding wheel. By using the airbag to convert the system to a soft-touch approach, we gain a repeatable consistent grinding pressure against the glass edge while allowing the grinding wheel a wider compliance swing to compensate for product placement.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

The invention claimed is:

1. A method of making a glass sheet with at least one finished lateral edge, the method comprising:

conveying the glass sheet past at least one grinding wheel;

biasing the grinding wheel against a lateral edge of the glass sheet so that the grinding wheel grinds at least part of the lateral edge of the glass sheet;

wherein said biasing includes using an airbag and air pressure regulator in communication with the airbag to bias the grinding wheel against the lateral edge of the glass sheet, and controlling the air pressure regulator and the airbag so that one inch of lateral movement of the edge of the glass sheet toward the grinding wheel, from a normal operating position of the edge, causes the pressure inside the airbag to change by no more than about 1 psi.

2. The method of claim 1, wherein the air pressure regulator maintains a pressure of from about 2–10 psi in the airbag.

3. The method of claim 1, wherein the air pressure regulator maintains a pressure of from about 3–6 psi in the airbag.

4. The method of claim 1, wherein one inch of lateral movement of the edge of the glass sheet toward the grinding wheel, from a normal operating position of the edge, causes the pressure inside the airbag to change by no more than about 0.5 psi.

5. The method of claim 1, wherein one inch of lateral movement of the edge of the glass sheet toward the grinding wheel, from a normal operating position of the edge, causes the pressure inside the airbag to change by no more than about 0.25 psi.

6. The method of claim 1, wherein one inch of lateral movement of the edge of the glass sheet toward the grinding wheel, from a normal operating position of the edge, causes the pressure inside the airbag to change by no more than about 10%.

7. The method of claim 1, wherein one inch of lateral movement of the edge of the glass sheet toward the grinding wheel, from a normal operating position of the edge, causes the pressure inside the airbag to change by no more than about 5%.

8. The method of claim 1, further comprising providing an airbag support comprising at least first and second approximately parallel members, and wherein channels on inner surfaces of the approximately parallel members allow the airbag to be moved toward and away from the edge of the glass sheet.

9. The method of claim 1, wherein the airbag provides a biasing force against a pivot swing arm on which the grinding wheel is rotatably mounted.

10. The method of claim 1, further comprising thermally tempering the glass sheet after the edge of the glass sheet has been ground.

11. A method of grinding at least one edge of a glass sheet, the method comprising:

conveying the glass sheet by at least one grinding wheel;

biasing the grinding wheel against a lateral edge of the glass sheet so that the grinding wheel grinds at least part of the lateral edge of the glass sheet, the biasing comprising using an airbag to bias the grinding wheel against the lateral edge of the glass sheet; and controlling the airbag and an air pressure regulator in communication with the airbag in a manner so that one inch of lateral movement of the edge of the glass sheet toward the grinding wheel, from a normal operating position of the edge, causes the pressure inside the airbag to change by no more than about 10%.

12. A system for grinding at least one edge of a glass sheet, the system comprising:

a conveyor system for conveying a glass sheet past at least one grinding wheel;

the grinding wheel for contacting a lateral edge of the glass sheet so as to grind at least part of the lateral edge of the glass sheet;

an airbag, and an air pressure regulator in communication with the airbag, for biasing the grinding wheel against the lateral edge of the glass sheet; and means for controlling the airbag and an air pressure regulator in communication with the airbag in a manner so that one inch of lateral movement of the edge of the glass sheet toward the grinding wheel, from a normal operating position of the edge, causes the pressure inside the airbag to change by no more than about 10%.

13. The system of claim 12, wherein the air pressure regulator maintains a pressure of from about 2–10 psi in the airbag.

14. The system of claim 12, wherein the air pressure regulator maintains a pressure of from about 3–6 psi in the airbag.

15. The system of claim 12, wherein one inch of lateral movement of the edge of the glass sheet toward the grinding wheel, from a normal operating position of the edge, causes the pressure inside the airbag to change by no more than about 2 psi.

16. The system of claim 12, wherein one inch of lateral movement of the edge of the glass sheet toward the grinding wheel, from a normal operating position of the edge, causes the pressure inside the airbag to change by no more than about 1 psi.

17. The system of claim 12, wherein one inch of lateral movement of the edge of the glass sheet toward the grinding wheel, from a normal operating position of the edge, causes the pressure inside the airbag to change by no more than about 0.5 psi.

18. The system of claim 12, wherein one inch of lateral movement of the edge of the glass sheet toward the grinding wheel, from a normal operating position of the edge, causes the pressure inside the airbag to change by no more than about 5%.

* * * * *